US009659577B1

(12) United States Patent
Langhammer

(10) Patent No.: US 9,659,577 B1
(45) Date of Patent: May 23, 2017

(54) VOICE CONTROLLED ASSISTANT WITH INTEGRATED CONTROL KNOB

(71) Applicant: Rawles LLC, Wilmington, DE (US)

(72) Inventor: Heinz-Dominik Langhammer, San Francisco, CA (US)

(73) Assignee: Amazon Technologies, Inc., Seattle, WA (US)

( * ) Notice: Subject to any disclaimer, the term of this patent is extended or adjusted under 35 U.S.C. 154(b) by 336 days.

(21) Appl. No.: 13/804,967

(22) Filed: Mar. 14, 2013

(51) Int. Cl.
*H04R 5/02* (2006.01)
*G10L 21/06* (2013.01)
*H04R 29/00* (2006.01)

(52) U.S. Cl.
CPC ..... *G10L 21/06* (2013.01)

(58) Field of Classification Search
CPC G06F 3/0362; H01H 2025/043; H04R 1/345; H04R 5/02
USPC ..... 381/336; 704/553; 370/260
See application file for complete search history.

(56) References Cited

U.S. PATENT DOCUMENTS 7,418,392 B1 8/2008 Mozer et al.
7,720,683 B1 5/2010 Vermeulen et al.
7,774,204 B2 8/2010 Mozer et al.
7,978,186 B2 * 7/2011 Vassallo et al. ..... 345/184
8,056,441 B2 * 11/2011 Lu ..... 74/553
2005/0286443 A1 * 12/2005 McMillen et al. ..... 370/260
2006/0250382 A1 * 11/2006 Lee ..... H05B 33/0845 345/184
2009/0207590 A1 * 8/2009 Tsung ..... 362/100
2011/0298885 A1 * 12/2011 Root ..... 348/14.1
2012/0075407 A1 * 3/2012 Wessling ..... 348/14.08
2012/0223885 A1 9/2012 Perez
2013/0217351 A1 * 8/2013 Jarvinen ..... H04B 1/086 455/230

FOREIGN PATENT DOCUMENTS

WO WO2011088053 A2 7/2011

OTHER PUBLICATIONS

Pinhanez, "The Everywhere Displays Projector: A Device to Create Ubiquitous Graphical Interfaces", IBM Thomas Watson Research Center, Ubicomp 2001, Sep. 30-Oct. 2, 2001, 18 pages.

* cited by examiner

*Primary Examiner* — Paul S Kim
*Assistant Examiner* — Norman Yu
(74) *Attorney, Agent, or Firm* — Lee & Hayes, PLLC

(57) ABSTRACT

A voice controlled assistant has a housing to hold one or more microphones, one or more speakers, and various computing components. The housing has an elongated cylindrical body extending along a center axis between a base end and a top end. The microphone(s) are mounted in the top end and the speaker(s) are mounted proximal to the base end. A control knob is rotatably mounted to the top end of the housing to rotate about the center axis. The control knob has an outer surface that is substantially flush with an outer surface of the housing to provide a smooth, continuous appearance to the voice controlled assistant.

19 Claims, 7 Drawing Sheets

VOICE CONTROLLED ASSISTANT WITH INTEGRATED CONTROL KNOB

BACKGROUND

Homes are becoming more connected with the proliferation of computing devices such as desktops, tablets, entertainment systems, and portable communication devices. As these computing devices evolve, many different ways have been introduced that allow users to interact with computing devices, such as through mechanical devices (e.g., keyboards, mice, etc.), touch screens, motion, and gesture. Another way to interact with computing devices is through speech.

To implement speech interaction, the device is commonly equipped with a microphone to receive voice input from a user and a speech recognition component to recognize and understand the voice input. The device also commonly includes a speaker to emit audible responses to the user. With speech interaction, the device may be operated essentially "hands free". For some operations, however, voice operation may not be intuitive or easily implemented. Accordingly, there is a continuing need for improved designs of voice enabled devices that are intuitive and easy to operate.

BRIEF DESCRIPTION OF THE DRAWINGS

The detailed description is described with reference to the accompanying figures. In the figures, the left-most digit(s) of a reference number identifies the figure in which the reference number first appears. The same reference numbers in different figures indicate similar or identical items.

DETAILED DESCRIPTION

A voice controlled assistant having an integrated manual control knob is described. The voice controlled assistant is discussed in the context of an architecture in which the assistant is connected to far end talkers or a network accessible computing platform, or "cloud service", via a network. The voice controlled assistant may be implemented as a hands-free device equipped with a wireless LAN (WLAN) interface. The voice controlled assistant relies primarily, if not exclusively, on voice interactions with a user. However, for certain operations, the manual control knob provides an intuitive mechanical means for user input.

To illustrate one example usage scenario, the voice controlled assistant may be positioned in a room (e.g., at home, work, store, etc.) to receive user input in the form of voice interactions, such as spoken requests or a conversational dialogue. Depending on the request, the voice controlled assistant may perform any number of actions. For instance, the assistant may play music or emit verbal answers to the user. The assistant may alternatively function as a communication device to facilitate network voice communications with a far end talker. As still another alternative, the user may ask a question or submit a search request to be performed by a remote cloud service. For instance, the user's voice input may be transmitted from the assistant over a network to the cloud service, where the voice input is interpreted and used to perform a function. In the event that the function creates a response, the cloud service transmits the response back over the network to the assistant, where it may be audibly emitted to the user.

When using speech as the primary interaction, however, the user may encounter situations when the hands-free device is not as intuitive or easy to operate as might be expected. For instance, suppose the user is in the midst of a conversation using the voice controlled assistant and the user would like to adjust the volume of the audio output. In a purely voice controlled mode of operation, the device expects to receive the command vocally. However, it may be difficult for the device to differentiate between words in the conversation and a volume control command.

To alleviate this potential confusion, the voice controlled assistant is constructed with an integrated control knob that allows the user to make certain adjustments manually through use of the knob. For instance, the user may adjust the volume via the control knob while conducting the verbal conversation.

The architecture may be implemented in many ways. Various example implementations are provided below. However, the architecture may be implemented in many other contexts and situations different from those shown and described below.

Illustrative Environment and Device

Figure 1:
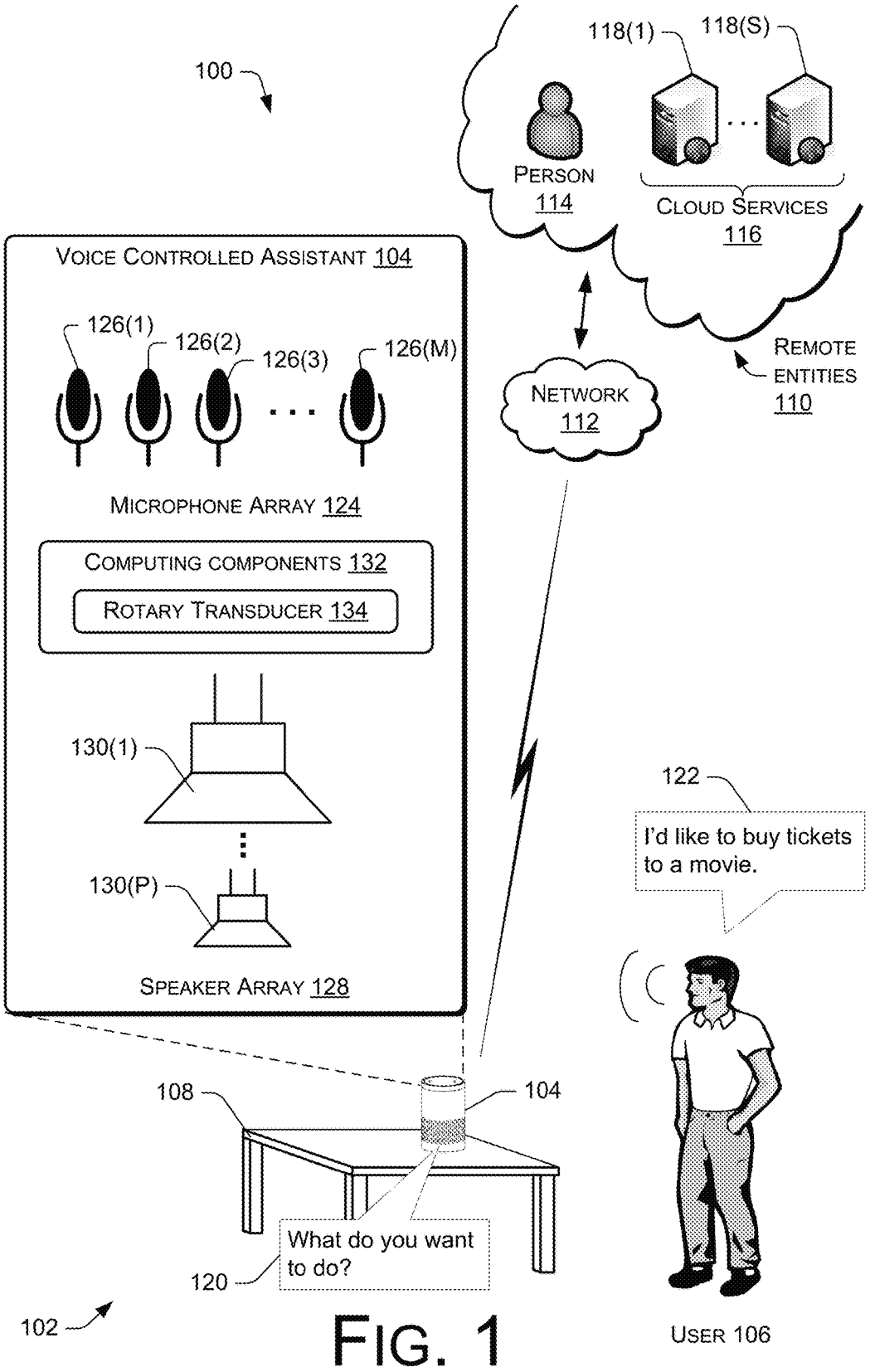
FIG. 1 shows an illustrative voice interactive computing architecture set in an example environment that includes a near end talker communicating with a far end talker or cloud service through use of a voice controlled assistant.

FIG. 1 shows an illustrative architecture 100, set in an exemplary environment 102, which includes a voice controlled assistant 104. In this example, the environment may be a room or an office, and a user 106 is present to interact with the voice controlled assistant 104. Although only one user 106 is illustrated in FIG. 1, multiple users may use the voice controlled assistant 104. The user 106 may be located proximal to the voice controlled assistant 104, and hence serve as a near end talker in some contexts.

In this illustration, the voice controlled assistant 104 is physically positioned on a table 108 within the environment 102. The voice controlled assistant 104 is shown sitting upright and supported on its base end. In other implementations, the assistant 104 may be placed in any number of locations (e.g., ceiling, wall, in a lamp, beneath a table, on a work desk, in a hall, under a chair, etc.). The voice controlled assistant 104 is shown communicatively coupled to remote entities 110 over a network 112. The remote entities 110 may include individual people, such as a person 114, or automated systems (not shown) that serve as far end talkers to verbally interact with the user 106. The remote entities 110 may alternatively comprise cloud services 116 hosted, for example, on one or more servers 118(1), . . . , 118(S). These servers 118(1)-(S) may be arranged in any number of ways, such as server farms, stacks, and the like that are commonly used in data centers.

The cloud services 116 generally refer to a network accessible platform implemented as a computing infrastructure of processors, storage, software, data access, and so forth that is maintained and accessible via a network such as the Internet. Cloud services 116 do not require end-user knowledge of the physical location and configuration of the system that delivers the services. Common expressions associated with cloud services include "on-demand computing", "software as a service (SaaS)", "platform computing", "network accessible platform", and so forth.

The cloud services 116 may host any number of applications that can process the user input received from the voice controlled assistant 104, and produce a suitable response. Example applications might include web browsing, online shopping, banking, email, work tools, productivity, entertainment, educational, and so forth.

In FIG. 1, the user 106 is shown communicating with the remote entities 110 via the voice controlled assistant 104. In the illustrated scenario, the voice controlled assistant 104 outputs an audible question, "What do you want to do?" as represented by dialog bubble 120. This output may represent a question from a far end talker 114, or from a cloud service 116 (e.g., an entertainment service). The user 106 is shown replying to the question by stating, "I'd like to buy tickets to a movie" as represented by the dialog bubble 122.

The voice controlled assistant 104 is equipped with an array 124 of microphones 126(1), . . . , 126(M) to receive the voice input from the user 106 as well as any other audio sounds in the environment 102. The microphones 126(1)-(M) are generally arranged at a first or top end of the assistant 104 opposite the base end seated on the table 108, as will be described in more detail with reference to FIGS. 3, 6, and 7. Although multiple microphones are illustrated, in some implementations, the assistant 104 may be embodied with only one microphone.

The voice controlled assistant 104 may further include a speaker array 128 of speakers 130(1), . . . , 130(P) to output sounds in humanly perceptible frequency ranges. The speakers 130(1)-(P) may be configured to emit sounds at various frequency ranges, so that each speaker has a different range. In this manner, the assistant 104 may output high frequency signals, mid frequency signals, and low frequency signals. The speakers 130(1)-(P) are generally arranged at a second or base end of the assistant 104 and oriented to emit the sound in a downward direction toward the base end and opposite to the microphone array 124 in the top end. One particular arrangement is described below in more detail with reference to FIG. 7. Although multiple speakers are illustrated, the assistant 104 may be embodied with only one speaker in other implementations.

The voice controlled assistant 104 may further include computing components 132 that process the voice input received by the microphone array 124, enable communication with the remote entities 110 over the network 112, and generate the audio to be output by the speaker array 128. The computing components 132 are generally positioned between the microphone array 124 and the speaker array 128, although essentially any other arrangement may be used. One collection of additional computing components 132 are illustrated and described with reference to FIG. 2.

Among the computing components 132 is a rotary transducer 134 that receives input from a manual control knob that is rotatably mounted on the assistant 104. The rotary transducer 134 translates the mechanical movement of the knob to a control signal for controlling any number of aspects, such as volume, treble, base, radio band selection, menu navigation, and so forth. The control knob is described below in more detail with reference to FIGS. 3-5.

Illustrative Voice Controlled Assistant

Figure 2:
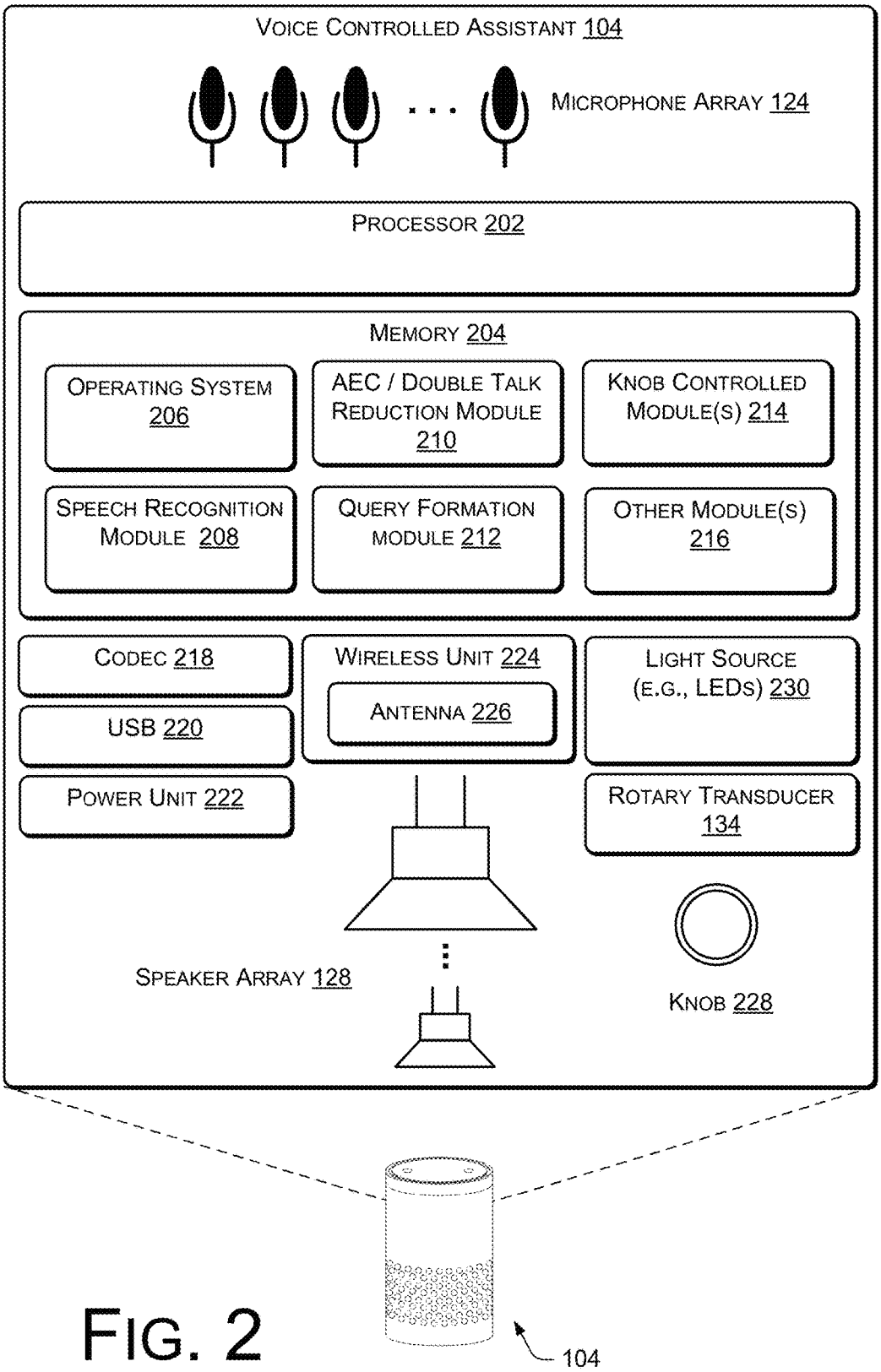
FIG. 2 shows a block diagram of selected functional components implemented in the voice controlled assistant of FIG. 1.

FIG. 2 shows selected functional components of the voice controlled assistant 104 in more detail. Generally, the voice controlled assistant 104 may be implemented as a standalone device that is relatively simple in terms of functional capabilities with limited input/output components, memory, and processing capabilities. For instance, the voice controlled assistant 104 may not have a keyboard or keypad. Nor does it have a display or touch screen to facilitate visual presentation and user touch input. Instead, the assistant 104 may be implemented with the ability to receive and output audio, a network interface (wireless or wire-based), power, and limited processing/memory capabilities.

In the illustrated implementation, the voice controlled assistant 104 includes the microphone array 124, the speaker array 128, a processor 202, and memory 204. The microphone array 124 may be used to capture speech input from the user 106, or other sounds in the environment 102. The speaker array 128 may be used to output speech from a far end talker, audible responses provided by the cloud services, forms of entertainment (e.g., music, audible books, etc.), or any other form of sound. The speaker array 128 may output a wide range of audio frequencies including both human perceptible frequencies and non-human perceptible frequencies.

The processor 202 may be implemented as any form of processing component, including a microprocessor, control logic, application-specific integrated circuit, and the like. The memory 204 may include computer-readable storage media ("CRSM"), which may be any available physical media accessible by the processor 202 to execute instructions stored on the memory. In one basic implementation, CRSM may include random access memory ("RAM") and Flash memory. In other implementations, CRSM may include, but is not limited to, read-only memory ("ROM"), electrically erasable programmable read-only memory ("EEPROM"), or any other medium which can be used to store the desired information and which can be accessed by the processor 202.

Several modules such as instruction, datastores, and so forth may be stored within the memory 204 and configured to execute on the processor 202. An operating system module 206 is configured to manage hardware and services (e.g., wireless unit, USB, Codec) within and coupled to the assistant 104 for the benefit of other modules. Several other modules may be provided to process verbal input from the user 106. For instance, a speech recognition module 208 provides some level of speech recognition functionality. In some implementations, this functionality may be limited to specific commands that perform fundamental tasks like waking up the device, configuring the device, and the like. The amount of speech recognition capabilities implemented on the assistant 104 is an implementation detail, but the architecture described herein can support having some speech recognition at the local assistant 104 together with more expansive speech recognition at the cloud services 116.

An acoustic echo cancellation (AEC) and double talk reduction module 210 are provided to process the audio signals to substantially cancel acoustic echoes and substantially reduce double talk that may occur. This module 210 may, for example, identify times where echoes are present, where double talk is likely, where background noise is present, and attempt to reduce these external factors to isolate and focus on the near talker. By isolating on the near talker, better signal quality is provided to the speech recognition module 208 to enable more accurate interpretation of the speech utterances.

A query formation module 212 may also be provided to receive the parsed speech content output by the speech recognition module 208 and to form a search query or some form of request. This query formation module 212 may utilize natural language processing (NLP) tools as well as various language modules to enable accurate construction of queries based on the user's speech input.

One or more knob controlled modules 214 may also be stored in the memory 204 to receive control signals from the rotary transducer 134 and modify operation of corresponding applications or functionality. Examples of knob-controlled modules 214 may include modules that facilitate volume control, other audio control (e.g., base, treble, etc.), menu navigation, radio band selection, and so forth.

The modules shown stored in the memory 204 are merely representative. Other modules 216 for processing the user voice input, interpreting that input, and/or performing functions based on that input may be provided.

The voice controlled assistant 104 might further include a codec 218 coupled to the microphones of the microphone array 124 and the speakers of the speaker array 128 to encode and/or decode the audio signals. The codec 218 may convert audio data between analog and digital formats. A user may interact with the assistant 104 by speaking to it, and the microphone array 124 captures the user speech. The codec 218 encodes the user speech and transfers that audio data to other components. The assistant 104 can communicate back to the user by emitting audible statements passed through the codec 218 and output through the speaker array 128. In this manner, the user interacts with the voice controlled assistant simply through speech, without use of a keyboard or display common to other types of devices.

A USB port 220 may further be provided as part of the assistant 104 to facilitate a wired connection to a network, or a plug-in network device that communicates with other wireless networks. In addition to the USB port 220 or as an alternative thereto, other forms of wired connections may be employed, such as a broadband connection. A power unit 222 is further provided to distribute power to the various components on the assistant 104.

The voice controlled assistant 104 includes a wireless unit 224 coupled to an antenna 226 to facilitate a wireless connection to a network. The wireless unit 224 may implement one or more of various wireless technologies, such as wife, Bluetooth, RF, and so on.

The voice controlled assistant 104 is further equipped with a mechanical knob 228, which is illustrated diagrammatically in FIG. 2, but will be described in more detail with respect to FIGS. 3-5. The knob 228 is rotatably mounted on the assistant 104 and upon rotation, the rotary transducer 134 converts the mechanical movement to an electrical signal that may be passed to the knob controlled modules 214. In some implementations, the knob 228 is fitted with a light piping that may be illuminated, as will be discussed in more detail with respect to FIG. 3. Accordingly, a light source 230, such as one or more LEDs, may also be provided in the voice controlled assistant 104 to provide one or more colors of light to the light piping during operation of the knob 228.

The voice controlled assistant 104 is designed to support audio interactions with the user, in the form of receiving voice commands (e.g., words, phrase, sentences, etc.) from the user and outputting audible feedback to the user. Accordingly, in the illustrated implementation, there are no keypads, joysticks, keyboards, touch screens, and the like. Further there is no display for text or graphical output. In one implementation described below, the voice controlled assistant 104 includes a few control mechanisms, such as the knob 228, two actuatable buttons, and possibly power and reset buttons. But, otherwise, the assistant 104 relies primarily on audio interactions.

Accordingly, the assistant 104 may be implemented as an aesthetically appealing device with smooth and rounded surfaces, with apertures for passage of sound waves, and merely having a power cord and optionally a wired interface (e.g., broadband, USB, etc.). In some implementations, a power light may be included at the base or bottom of the assistant 104 to indicate when the device is powered on. An on/off power switch may further be included in some configurations.

In the illustrated implementation, the assistant 104 has a housing of an elongated cylindrical shape. Apertures or slots are formed in a base end to allow emission of sound waves. A more detailed discussion of one particular structure is provided below with reference to FIGS. 3-7. Once plugged in, the device may automatically self-configure, or with slight aid of the user, and be ready to use. As a result, the assistant 104 may be generally produced at a low cost. In other implementations, other I/O components may be added to this basic model, such as additional specialty buttons, a keypad, display, and the like.

Figure 3:
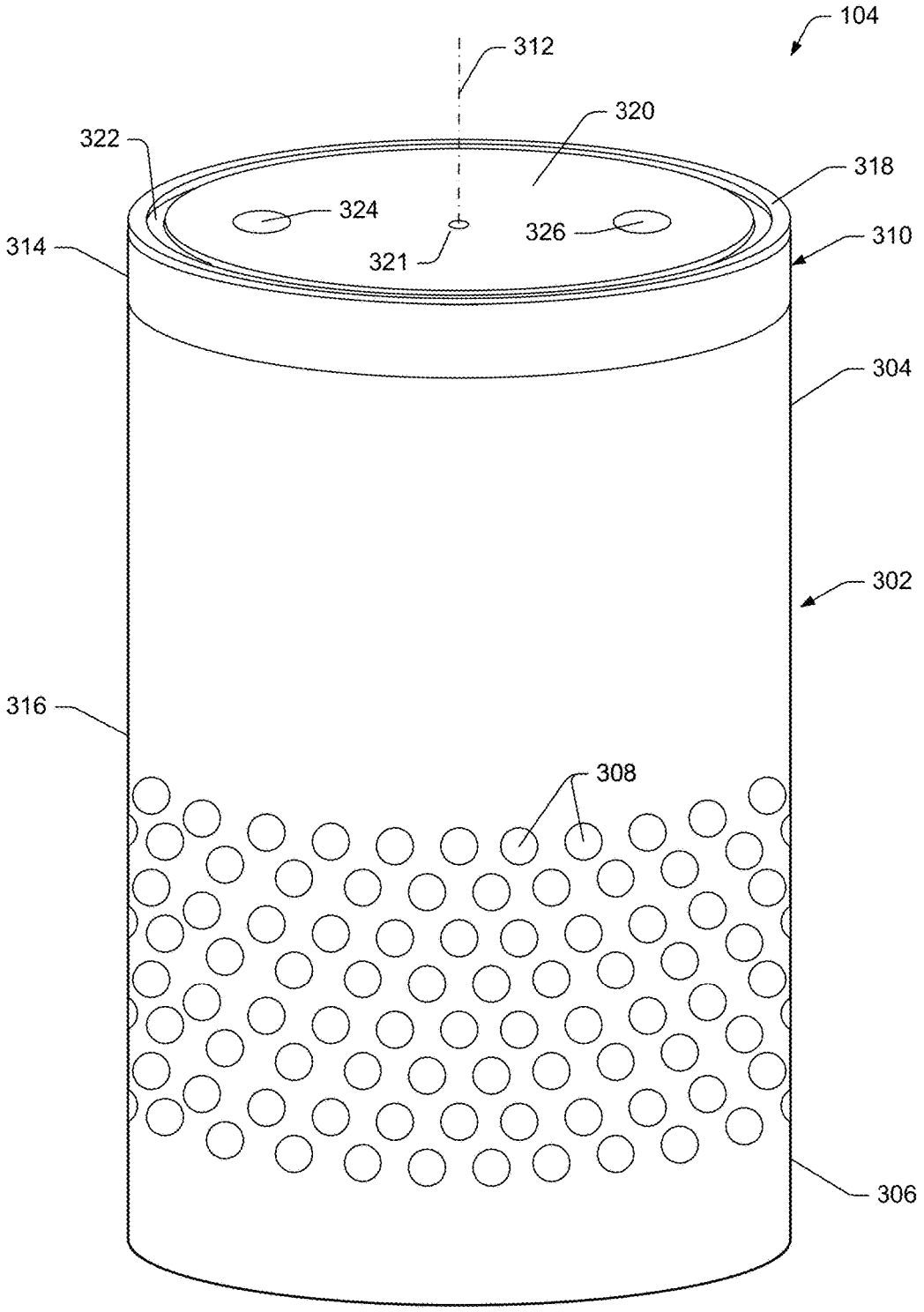
FIG. 3 is a perspective view of one implementation of the voice controlled assistant of FIG. 1 to illustrate a control knob integrated with a cylindrical housing of the voice controlled assistant.

FIG. 3 is a perspective view of one example implementation of the voice controlled assistant 104. The assistant 104 has a cylindrical body or housing 302 with an upper or top end 304 and a lower or base end 306. The base end 306 of the housing 302 has multiple openings or apertures 308 to permit emission of sound waves generated by the speakers (not shown in FIG. 3) contained within the housing. In other implementations, the openings 308 may be in other locations, such as a band about the middle of the cylindrical housing or closer to the top end 304. The openings 308 may be arranged in any layout or pattern, essentially anywhere on the device, depending in part on the location of the one or more speakers housed therein.

One implementation of the control knob 228 is illustrated in FIG. 3 as an annular wheel-like knob 310 mounted near the top end 304 of the housing 302 to rotate about a center axis 312 of the cylindrical body defining the housing. The knob 310 has a smooth outer surface 314 that is substantially vertically flush with an outer surface 316 of the housing 302. For instance, the housing's outer surface 316 is at a first radius from the center axis 312 and the knob's outer surface 314 is at a second radius from the center axis 312, and the first and second radii are approximately equal. In this manner, the knob 310 maintains the smooth and continuous cylindrical shape of the housing 302 to promote an elegant design where the knob 310 seamlessly integrates with the cylindrical housing 302 and does not conspicuously stand out as a separate appendage. Additionally, the knob 310 enjoys a large diameter to permit more precise mechanical movement and control. The knob 310 may be infinitely rotatable in either direction, with no mechanical limit for clockwise or counterclockwise rotation. As a result, a user may easily and finely control various functions by grasping and turning the knob 310 or by using a finger to rotate the knob 310.

The knob 310 has an upper peripheral edge that is fitted with an edge pipe 318, which may be used as an annular signaling indicator. The edge pipe 318 is a light pipe that is used to channel light emitted by the light source 230. The edge pipe 318 is formed of a light transmissive material that may receive light from the light source 230 (e.g., one or more LEDs) so that the edge pipe 318 may be illuminated. Due to its location at the top end 304, the edge pipe 318, when illuminated, is visible from all directions and may be easily seen in the dark to aid in user operation of the knob 310. The edge pipe 318 may be illuminated using a single color or many different colors. Similarly, the pipe 318 may be illuminated as a solid annular ring or as individual segments. The segments may even be controlled in a way to provide an animated appearance (e.g., flashing segments, turning segments on/off in a pattern, etc.). The various appearances may be assigned to different functions, such as to differentiate rest mode from operational mode, or to communicate different states of operation (e.g., when in mute or privacy), or to communicate different types of functionality (e.g., receiving or storing a message), or to illustrate associated knob operation (e.g., illuminating more segments as the user turns the knob), and so forth.

Figure 4:
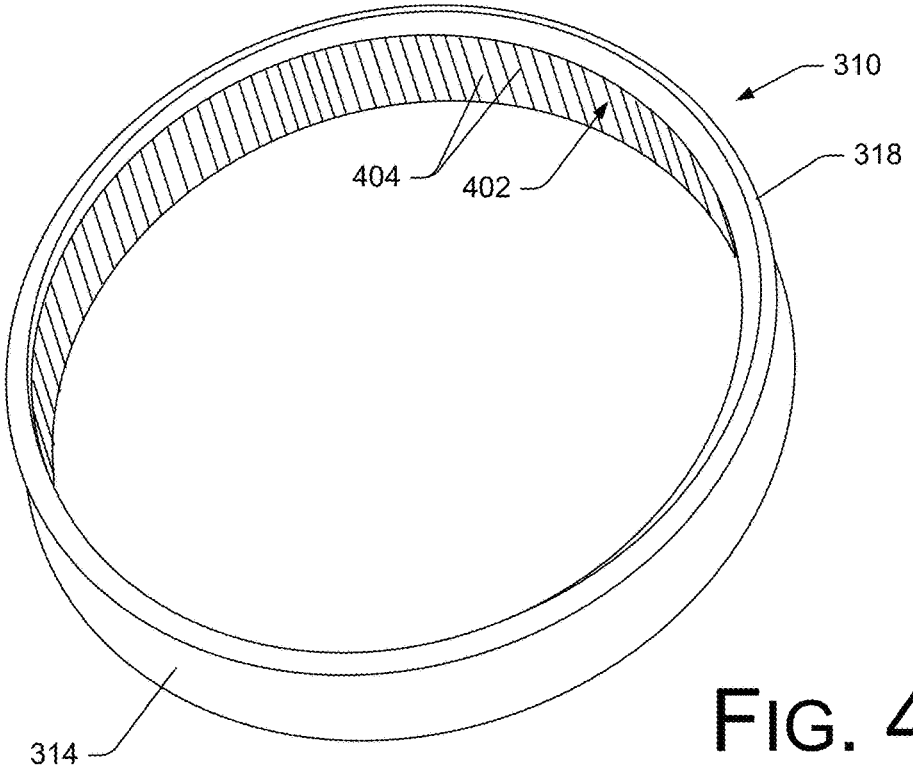
FIG. 4 shows one example implementation of the control knob of FIG. 3 in more detail.

FIG. 4 shows the control knob 310 of FIG. 3 in more detail. The knob 310 is an annular ring member having an outer surface 314 and an inner surface 402. In one implementation, the knob is constructed with a thickness between the inner surface 402 and the outer surface 314 and an overall weight that provides a quality tactile experience with improved precision feel. The edge pipe 318 is arranged around one edge or lip of the knob 310. The inner surface 402 has a set of gear teeth 404 that engage a complementary gear member internal to the knob 310.

Figure 5:
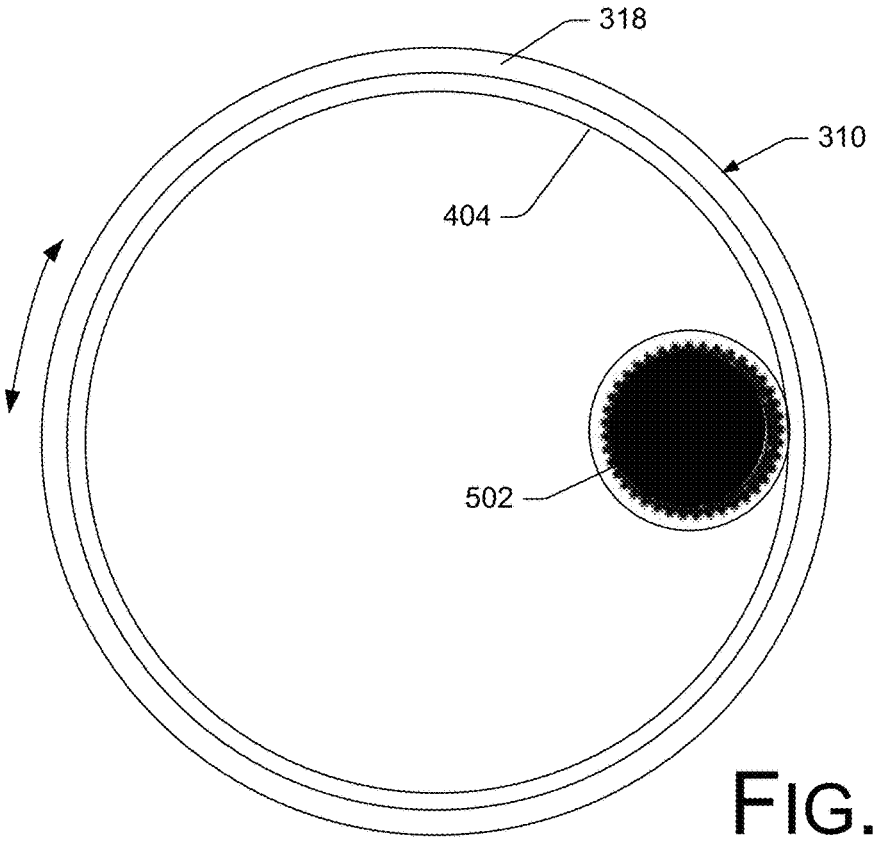
FIG. 5 shows one example implementation of the control knob of FIG. 3 integrated with complementary internal gearing within the voice controlled assistant.

FIG. 5 shows one example mechanical arrangement in which the knob 310 engages a complementary gear member 502. Rotation of the knob 310, either clockwise or counter-clockwise, causes mechanical movement of the inner gear teeth 404 relative to the complementary gear member 502, which in turn rotates the gear member 502 in the same direction. The gear member 502 is operationally coupled to the rotary transducer 134 that generates an electrical signal based on the movement of the gear member 502.

With reference again to FIG. 3, the knob 310 rotates around a circular end cap 320, which remains stationary. The circular end cap 320 may be formed of a hard, protective material, such as plastic. In such implementations, a center hole 321 may be provided in the end cap 320 to permit sound transmission to one or more microphones positioned beneath the end cap 320. Alternatively, the end cap 320 may be formed of a material that is transmissive to sound waves, as one or more microphones may be placed beneath the surface. In one implementation, a groove 322 is formed between the edge pipe 318 of the knob 310 and the end cap 320. The groove 322 recesses into the assistant from the outer surface formed by the end cap 320. The groove 322 may be, for example, at a depth of 1 mm to 5 mm, with 2 mm being one example suitable distance. In still another implementation, a sound transmissive material, such as a mesh, may be used to cover the groove 322 or components, such as microphones, positioned in the groove.

Two actuatable buttons 324 and 326 are exposed through corresponding openings in the end cap 318. These buttons 324 and 326 may be implemented, for example, with on/off states and may be assigned to control essentially any binary functionality. In one implementation, the left button 324 may be used to enable/disable the microphones (i.e., place the assistant in a privacy mode) and the right button 326 may be used for any other assignable function. The buttons 324 and 326 may be configured with different tactile profiles (e.g., different surfaces, shapes, texture, etc.) to exhibit different tactile experiences for the user, so that the buttons may be identified in low or dark lighting conditions simply through touch. The buttons may also be configured to be illuminated for easy viewing in low or dark lighting conditions.

One or more microphones may be positioned in the groove 322. There are many possible arrangements of the microphones in the microphone array. In one implementation, the assistant 104 is equipped with six microphones in the groove 322 between the knob 310 and the end cap 320 and a seventh microphone is positioned centrally at the axis 312 beneath the surface of the end cap 320. If the end cap 320 is formed of a hard, protective plastic, an aperture or opening 321 may be formed at the center point above the seventh microphone. Alternatively, a hole pattern may be stamped into the plastic end cap 320 to generally permit passage of sound waves to the underlying microphones.

Figure 6:
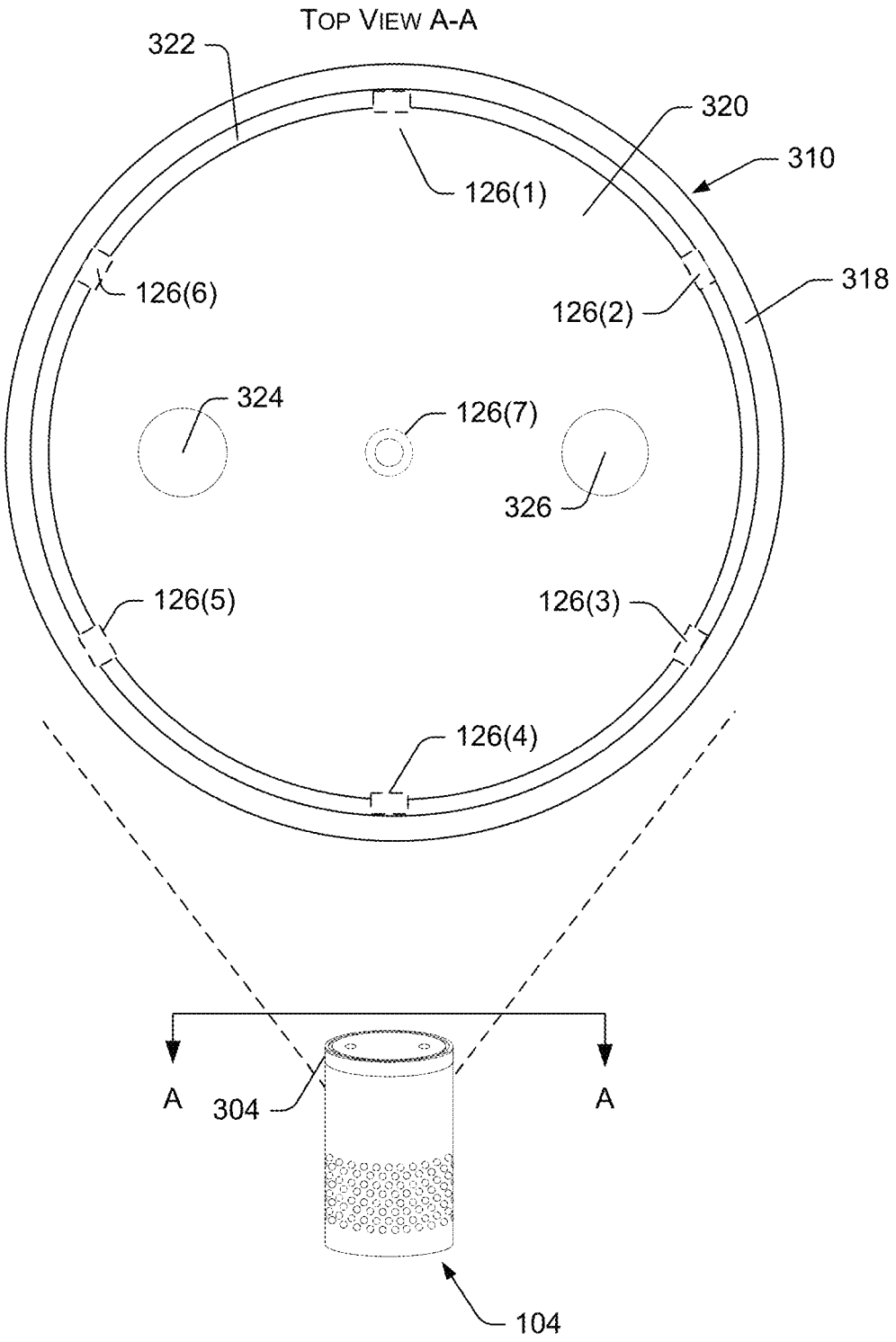
FIG. 6 shows a top down view of the voice controlled assistant of FIG. 3 to illustrate a light edge pipe arranged on the control knob and an example arrangement of microphones to form a microphone array.

FIG. 6 shows one example arrangement of microphones in the top end 304. More particularly, FIG. 6 shows a top down view of the voice controlled assistant 104 taken along line A-A to illustrate the end cap 320 at the upper end 304 of the housing 302. In this example, the microphone array has seven microphones 126(1), . . . , 126(7). Six of the microphones 126(1)-(6) are placed within the groove 322 between the perimeter of the end cap 320 and the knob 310, and are oriented so that the microphones are exposed into the groove 322 to receive sound. A mesh or other sound transmissive material may be placed over the microphones to prevent dust or other contaminants from affecting the microphones. A seventh microphone 126(7) is positioned at the center point of the circular end cap 320 and beneath an opening in the end cap 320 or a sound transmissive material. It is noted that this is merely one example arrangement. Arrays with more or less than seven microphones may be used, and other layouts are possible.

Figure 7:
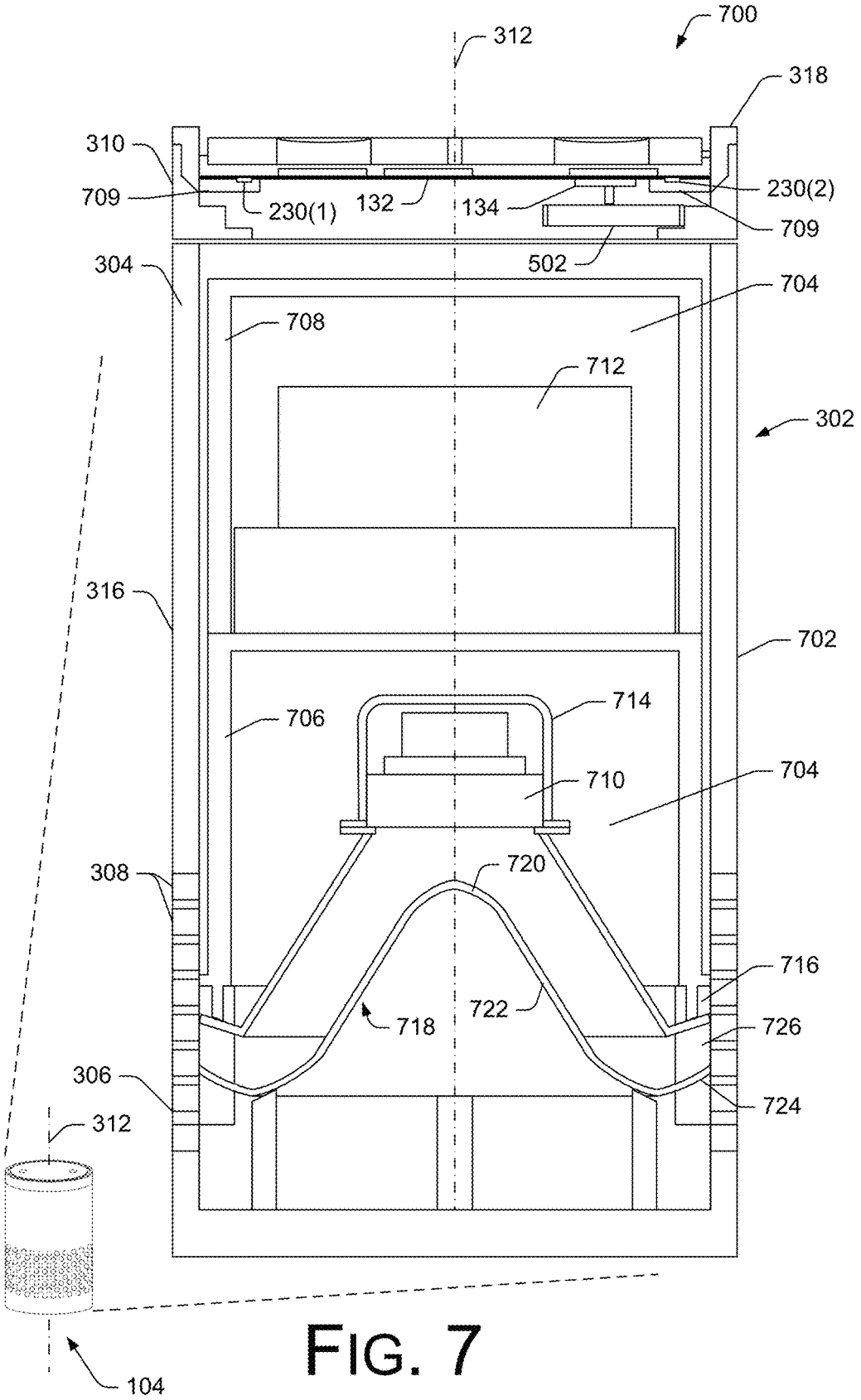
FIG. 7 is a cross sectional view of the voice controlled assistant of FIG. 3 according to one example implementation in which two speakers are coaxially aligned.

FIG. 7 is a cross sectional view 700 of the voice controlled assistant 104 taken along a plane that intersects the center axis 312 of the cylindrical-shaped housing 302. The housing 302 has an elongated, cylindrical-shaped middle section 702 extending between the first, lower or base end 306 and a second, upper, or top end 304. The cylindrical-shaped middle section 702 has a smooth outer surface 316 and due to the rounded shape, the two ends 304 and 306 are circular in shape. The base end 306 is designed to rest on a surface, such as a table 108 in FIG. 1, to support the housing 302. In this position, the top end 304 is distal and upward relative to the base end 306.

The housing 302 defines a hollow chamber 704. Within this chamber 704 are two skeletal members: a first or lower skeletal member 706 that provides structural support for components in the lower half of the chamber 704 and a second or upper skeletal member 708 that provides structural support for components in the upper half of the chamber 704.

The computing components 132 are mounted to the upper skeletal member 708, with one example configuration having the components mounted on a printed circuit board (PCB) positioned just below the end cap 320. The computing components 132 may include any number of processing and memory capabilities, as well as power, codecs, network interfaces, and so forth. Example components are shown in FIG. 2. The PCB may further hold the microphones 126(1)-(M), which are not shown in FIG. 7. Further, a light source for the edge pipe 318 may be mounted to the PCB. In one implementation, the light source may be formed as multiple (e.g., 12) multi-colored light sources, such as RGB LEDs. In FIG. 7, two LEDs 230(1) and 230(2), are shown mounted to the PCB 132 and optically connected to a light pipe diffusion ring 709, which is also mounted to the PCB. The light diffusion ring 709 is then optically coupled to the edge pipe 318. In this manner, each of the LEDs 230 may emit light in various colors, which is conveyed through the diffusion ring 709 to the edge pipe 318 exposed on the other rim of the knob 310 so that the light ring can be viewed from all directions. It is noted that some or all of the computing components 132 may be situated in other locations within the housing 302.

Two speakers are shown mounted in the housing 302. A first speaker 710 is shown mounted within the lower skeletal member 706. The first speaker 710 outputs a first range of frequencies of audio sound. In one implementation, the first speaker 710 is a mid-high frequency speaker that plays the middle to high frequency ranges in the human-perceptible audible range. A second speaker 712 is shown mounted within the upper skeletal member 708 elevationally above the first speaker 710 with respect to the base end 306. In this implementation, the second speaker 712 is a low frequency speaker that plays the low frequency ranges in the human-perceptible audible range. The mid-high frequency speaker 710 is smaller than the low frequency speaker 712.

The two speakers 710 and 712 are mounted in a coaxial arrangement along the center axis 312, with the low frequency speaker 712 atop the mid-high frequency speaker 710. The speakers are also coaxial along the center axis 312 to the microphone array, or more particularly, to the plane containing the microphone array. The middle microphone 126(7) (not shown in this figure) is positioned at the center point and lies along the center axis 312. Further, the two speakers 710 and 712 are oriented to output sound in a downward direction toward the base end 306 and away from the microphones mounted in the top end 304. The low frequency speaker 712 outputs sound waves that pass through one or more openings in the lower skeletal member 706. The low frequency waves may emanate from the housing in any number of directions. Said another way, in some implementations, the low frequency speaker 712 may function as a woofer to generate low frequency sound waves that flow omni-directionally from the assistant 104.

The mid-high frequency speaker 710 is mounted within a protective shielding 714, which provides a shield to the sound waves emitted from the low frequency speaker 712. Small openings or slots 716 are formed in the lower skeletal member 706 near the base end 306 of the housing 302 to pass sound waves from the chamber 704, although the low frequency waves need not be constrained to these slots.

The mid-high frequency speaker 710 emits mid-high frequency sound waves in a downward direction onto a sound distribution cone 718 mounted to the base end 306. The sound distribution cone 718 is coaxially arranged in the housing 302 along the center axis 312 and adjacent to the mid-high frequency speaker 710. The sound distribution cone 718 has a conical shape with a smooth upper nose portion 720, a middle portion 722 with increasing radii from top to bottom, and a lower flange portion 724 with smooth U-shaped flange. The sound distribution cone 718 directs the mid-high frequency sound waves from the mid-high frequency speaker 710 along the smooth conical surface downward along the middle portion 722 and in a radial outward direction from the center axis 312 along the lower flange portion 724 at the base end 306 of the housing 302. The radial outward direction is substantially perpendicular to the initial downward direction of the sound along the center axis 312. In this manner, the sound distribution cone 718 essentially delivers the sound out of the base end 306 of the housing 302 symmetrical to, and equidistance from, the microphone array in the top end 304 of the housing. The sound distribution cone 718 may also have the effect of amplifying the sound emitted from the mid-high frequency speaker 710.

Slots 726 are formed between the lower skeletal member 706 and the cone 718 to permit passage of the sound waves, and particularly the high frequency sound waves, emitted from the mid-high frequency speaker 710. In addition, apertures 308 are formed in the outer housing 702 to permit emission of the sound waves.

The knob 310 is rotatably mounted at the top end 304 of the housing 302 to rotate about the center axis 312. The knob 310 is mechanically coupled to the complementary gear 502. As the gear rotates, a rotary transducer 134 outputs a signal indicative of that rotation that may be passed to other modules to control various functions.

Illustrative Operation

Figure 8:
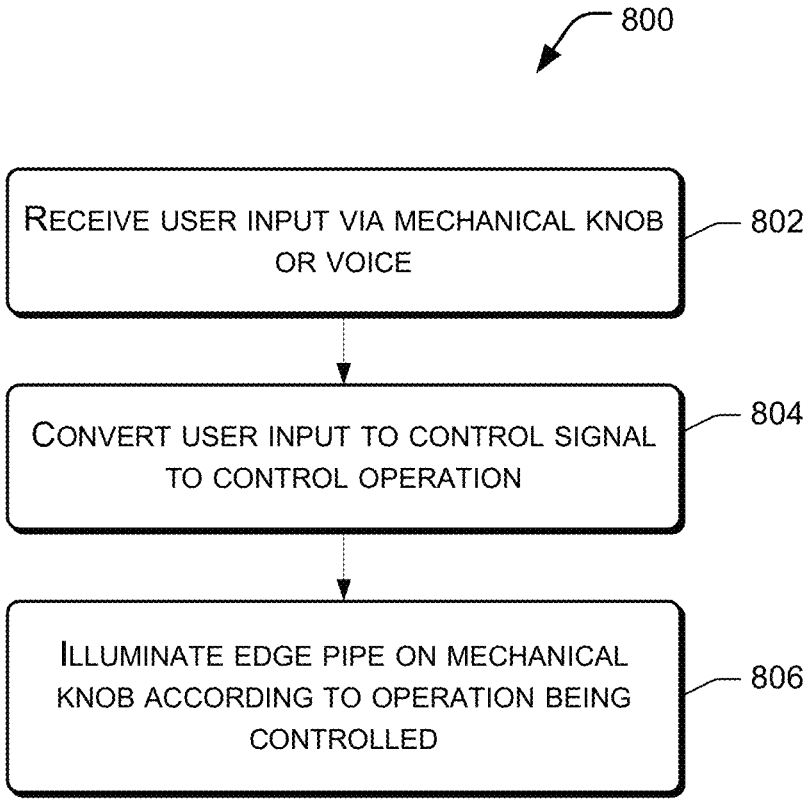
FIG. 8 is a flow diagram showing an illustrative process of operating the voice controlled assistant of FIG. 1.

FIG. 8 is a flow diagram of an illustrative process 800 to operate a communication device, such as the voice controlled assistant 104. This process (as well as other processes described throughout) is illustrated as a logical flow graph, each operation of which represents a sequence of operations that can be implemented in hardware, software, or a combination thereof. In the context of software, the operations represent computer-executable instructions stored on one or more tangible computer-readable storage media that, when executed by one or more processors, perform the recited operations. Generally, computer-executable instructions include routines, programs, objects, components, data structures, and the like that perform particular functions or implement particular abstract data types. The order in which the operations are described is not intended to be construed as a limitation, and any number of the described operations can be combined in any order and/or in parallel to implement the process.

For purposes of discussion, the process 800 is described with reference to the voice controlled assistant 104. However, the process may be performed by other electronic devices.

At 802, user input is received as either a mechanical rotation of the knob 310 or via voice input received by the one or more microphones 126(1)-(M) of the microphone array 124. Depending upon the implementation and environment, various computing components 132 may be used to process the voice input. As examples, the AEC/double talk module 210 may detect and cancel echoes in the input signal, as well as determine the likelihood of double talk and seek to reduce or eliminate that component in the input signal. In some implementations, once these and other non-primary components are removed from the audio input, a speech recognition module 208 can parse the resulting data in an effort to recognize the primary speech utterances from the near end talker. From this recognized speech, the query formation module 212 may form a query or request. This query or request may then be transmitted to a cloud service 116 for further processing and generation of a response and/or execution of a function.

At 504, the user input in converted to a control signal to control one or more operations. For instance, mechanical input via the knob 310 may be translated to a control signal to adjust volume, change a radio frequency, and so forth.

At 506, the edge pipe 318 of the knob 310 is selectively illuminated to provide indicia of the operation being controlled. For instance, the edge pipe may be illuminated a first color when a voice command is received and processed, or another color when a message is received from the cloud services. Alternatively, as the user twists the knob 310, the edge pipe 318 may be illuminated to represent progress or degree of rotation. For example, as the user turns the knob 310 to adjust volume, the light segments in the edge pipe 318 may turn on sequentially to increase the number of illuminated segments when adjusting the volume higher or turn off sequentially to decrease the number of illuminated segments when adjusting the volume lower.

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

What is claimed is:

1. A device comprising:

a housing comprising a cylindrical-shaped middle section extending between a top end and a base end along a center axis, the middle section having an outer surface at a radius from the center axis;

one or more microphones arranged proximal to the top end of the housing to receive audio;

a processor to process a signal representation of the audio;

memory accessible by the processor;

a network interface to communicate with a network;

one or more speakers arranged proximal to the base end of the housing to output audio sound;

a control knob rotatably mounted proximal to the top end of the housing to rotate about the center axis, the control knob having an outer surface at approximately the radius from the center axis so that the outer surface of the control knob is substantially vertically flush with the outer surface of the cylindrical-shaped middle section of the housing;

a rotary transducer to convert rotation of the control knob into a control signal for use in controlling one or more functions of the device; and a light conducting pipe mounted around an exterior peripheral edge of the outer surface of the control knob, the light conducting pipe being configured to display light external to the device in different appearance states corresponding to the one or more functions controlled by rotation of the control knob.

2. The device of claim 1, wherein the control signal produced by the rotary transducer is provided to the processor to at least one of adjust volume, adjust base, adjust treble, select a frequency band, or navigate a menu.

3. The device of claim 1, wherein the one or more speakers comprises:

a first speaker to output a first frequency range of audio sound; and a second speaker to output a second frequency range of audio sound that is different than the first frequency range.

4. The device of claim 1, wherein the housing further comprises an end cap at the top end, wherein a groove is formed between the end cap and the control knob and the one or more microphones are positioned proximal to the groove.

5. The device of claim 1, wherein the housing further comprises an end cap at the top end, and further comprising first and second buttons arranged to be exposed through the end cap, the first and second buttons having different tactile profiles.

6. A device comprising:

a housing having a center axis extending between a first end and a second end, the housing having an outer surface;

at least one speaker arranged in the housing;

a control knob rotatably mounted to the housing to rotate about the center axis, the control knob having an outer surface that is substantially vertically flush with the outer surface of the housing, wherein rotation of the control knob causes an input to perform at least one function; and a light conducting pipe mounted around an exterior peripheral edge of the outer surface of the control knob, the light conducting pipe configured to display light external to the device in different appearance states corresponding to the at least one function performed by rotation of the control knob.

7. The device of claim 6, wherein the outer surface of the housing is at a radius from the center axis and the outer surface of the control knob is at approximately the radius from the center axis.

8. The device of claim 6, further comprising at least one microphone arranged at the first end of the housing, and wherein the speaker is arranged at the second end of the housing.

9. The device of claim 6, wherein the at least one function comprises at least one of volume, base audio, treble audio, frequency band selection, or menu navigation.

10. The device of claim 6, wherein the light conducting pipe comprises an annular ring mounted along the exterior peripheral edge of the control knob.

11. An audio device comprising:

a cylindrical housing having a first outer surface at a first radius from a center axis;

at least one microphone to receive audio input;

at least one speaker to output audio sound;

an annular control knob rotatably mounted to the cylindrical housing to rotate about the center axis to facilitate control of at least one function of the audio device, the control knob having a second outer surface at a second radius from the center axis, wherein the first and second radii are substantially equal;

a rotary transducer to convert rotation of the control knob into a control signal for use in controlling the at least one function of the audio device; and a light conducting pipe mounted around an exterior peripheral edge of the second outer surface of the control knob, the light conducting pipe configured to display light external to the audio device in different appearance states corresponding to the at least one function controlled by rotation of the control knob.

12. The audio device of claim 11, wherein the at least one speaker comprises:

a first speaker to output a first frequency range of audio sound; and a second speaker to output a second frequency range of audio sound that is different than the first frequency range.

13. The audio device of claim 11, wherein the first and second outer surface are substantially vertically flush.

14. The audio device of claim 11, further comprising an electronic component arranged in the cylindrical housing, the at least one function being performed by the electronic component.

15. The audio device of claim 11, wherein the light conducting pipe comprises an annular ring mounted along the exterior peripheral edge of the control knob.

16. The audio device of claim 11, further comprising:

a processor;

memory accessible by the processor; and a speech recognition module stored in the memory and executable on the processor to recognize speech in a signal representation of the audio received by the at least one microphone.

17. The device of claim 1, wherein the light conducting pipe comprises an annular ring mounted on the exterior peripheral edge of the control knob.

18. The device of claim 1, wherein the light conducting pipe comprises a plurality of individual light segments mounted on the exterior peripheral edge of the control knob.

19. The device of claim 18, wherein the different appearance states comprise at least one of a: (i) first appearance state in which a first individual light segment displays a first color and a second individual light segment displays a second color, or (ii) second appearance state in which one or more individual light segments flash in at least one of a pattern or a sequence.

* * * * *